United States Patent [19]

Lee

[11] Patent Number: 4,739,291

[45] Date of Patent: Apr. 19, 1988

[54] MAGNETIC VACUUM CIRCUIT BREAKER

[76] Inventor: Wen-Fong Lee, No. 13-2, Lane 79, Sec. 1, Taichung Kang Rd., Taichung City, Taiwan

[21] Appl. No.: 70,401

[22] Filed: Jul. 7, 1987

[30] Foreign Application Priority Data

Dec. 8, 1986 [GB] United Kingdom ..... 8629288
May 8, 1987 [GB] United Kingdom ..... 8710992

[51] Int. Cl.[4] ..... H01H 73/12

[52] U.S. Cl. ..... 335/17; 335/21; 335/191

[58] Field of Search ..... 335/17, 6, 21, 191

[56] References Cited

U.S. PATENT DOCUMENTS 3,492,614 1/1970 Angelo et al. ..... 335/21
4,288,767 9/1981 Lee ..... 335/6

*Primary Examiner*—H. Broome
*Attorney, Agent, or Firm*—Lackenbach, Siegel Marzullo & Aronson

[57] ABSTRACT

A magnetic vacuum circuit breaker includes a sealed casing. Mounted in the casing are a stationary contact, a movable contact, a linkage connected to the movable contact, a tension for activating the linkage, and a stop device controllable by an electromagnet for normally hindering the linkage from the linking-up motion resulting from the tension force of the tension spring. A manual switch is provided for moving the movable contact to electrically connect with and disconnect from the stationary contact to thus close and open the circuit. An automatically indicating device is drivable by the linkage to indicate the state of overload or short-circuit when the circuit is converted into the same state. In addition, when the circuit is converted to the state of overload or short-circuit, the linkage is released from the stop device by the action of the electromagnet so that the movable contact is pulled by the tension spring away from the stationary contact to open the circuit. A pair of mutually attractable magnetic members are used to transfer motions between the linkage and the manual switch.

10 Claims, 5 Drawing Sheets

MAGNETIC VACUUM CIRCUIT BREAKER

BACKGROUND OF THE INVENTION

The present invention relates to a magnetic vacuum circuit breaker with a simple structure which transfers motion to open a power circuit by means of a linkage when the circuit is converted into the state of overload or short-circuit.

In conventional electrical switches, especially those used in power circuits, the contacts are exposed to air, whether the contacts are of the knife or magnetic type. These kinds of switches are unsuitable for use in dusty, moist, easily explosive or combustible environments. Several different types of switches for preventing explosions have been developed, such as oil switches, safety switches, and so forth. However, due to the complex structures of these switches, they are unpractical from a manufacturing standpoint. Accordingly, I disclosed an automatic magnetic switch in the U.S. Pat. application Ser. No. 967,712 filed on Dec. 8, 1978, which issued as U.S. Pat. No. 4,288,767. Although the automatic magnetic switch is simpler than the conventional switches in structure, it automatically opens a power circuit when the power circuit is converted into the state of overload or short-circuit by the complicated motion from a protection means 7 through a magnetic control means 10 to a magnetic contacting plate means 8, as shown in FIG. 1. It is thus desirable to further simplify the structure of the automatic magnetic switch.

SUMMARY OF THE INVENTION

An object of the present invention is to provide a simple circuit breaker which automatically opens a power circuit when the power circuit is converted into the state of overload or short-circuit.

Another object of the present invention is to provide a simple circuit breaker with a manual switch whereby once a power circuit is opened by automatically switching-off of the circuit breaker due to the state of overload or short-circuit, one can manually reset the manual switch to close the power circuit after eliminating the state of the overload or short-circuit, and whereby once the load is in an accidental emergency, one can instantly open the power circuit by manually switching the manual switch off.

Still another object of the present invention is to provide a simple circuit breaker with an automatically indicating device whereby the TRIP state of a power circuit is indicated when the power circuit is in the state of overload or short-circuit.

It is therefore the main feature of the present invention to provide a circuit breaker comprising a linkage whereby the circuit breaker automatically opens a power circuit when the power circuit is converted into the state of overload or short-circuit.

According to the present invention, the circuit breaker includes a casing; a contact device disposed sealingly in the casing and including a stationary contact and a movable contact normally contacting the stationary contact; a linkage connected to the movable contact in the casing; means for biasing the linkage and hence the movable contact away from the stationary contact; a stop device, normally hindering the linkage from movement for preventing the movable contact from movement away from the stationary contact, responsive to the state of overload or short-circuit by releasing the linkage therefrom to move the movable contact away from the stationary contact; a manual switch, selectively drivable by hand to achieve either the electrical connection or disconnection between the movable contact and the stationary contact; and an automatically indicating device drivable by the linkage to indicate the state of overload or short-circuit when the circuit is converted into the same state.

When the circuit is converted into the state of overload or short-circuit, the movable contact will move away from the stationary contact to open the circuit by the linking-up motion of the linkage, thereby causing the state of overload or short-circuit to be indicated on the automatically indicating device. The manual switch may be then reset to restore the circuit breaker to a normally closed condition.

BRIEF DESCRIPTION OF THE DRAWINGS

Other features and advantages of the present invention will become apparent from the following detailed description of a preferred embodiment of the present invention with reference to the accompanying drawings in which.

DETAILED DESCRIPTION OF THE PREFERRED EMBODIMENT

Figure 2:
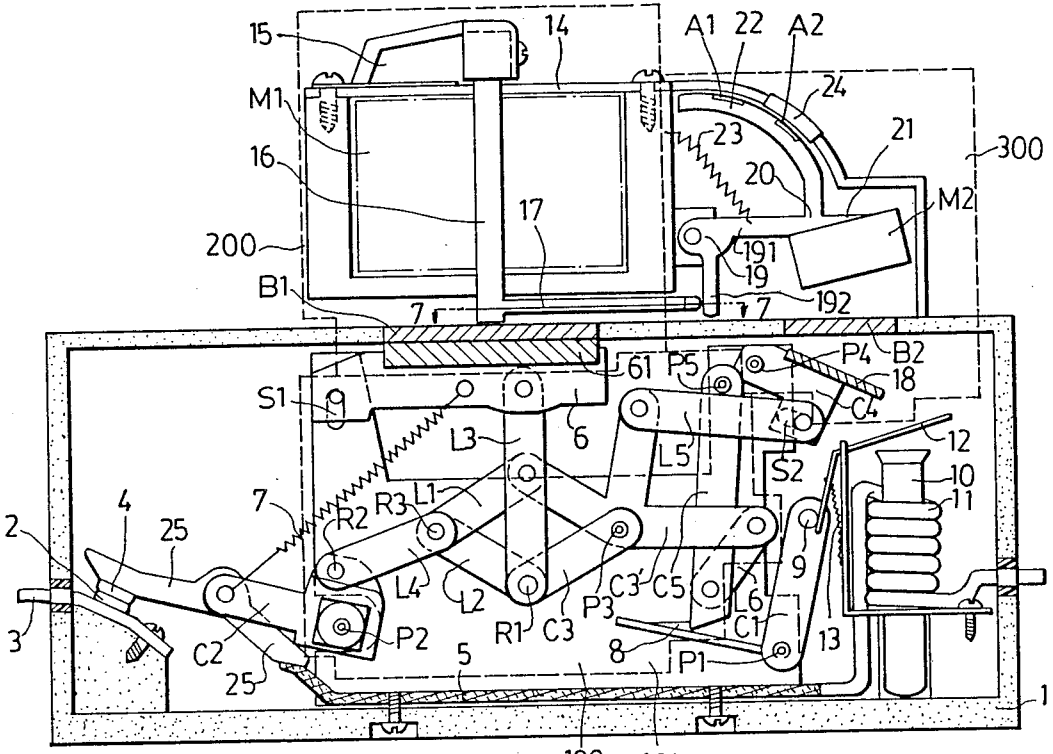
FIG. 2 is a vertical sectional view showing an embodiment of the magnetic vacuum circuit breaker according to the present invention when it is in a normal condition.

Referring to FIG. 2 with reference to FIGS. 3 to 7, there is shown a magnetic vacuum circuit breaker according to the present invention. The circuit breaker includes a sealed casing 1 in which a generally U-shaped stationary frame 101 is provided for mounting a linkage generally designated at 100 thereon. Mounted in the left of the casing 1 is a contact device which includes a stationary contact 2 electrically connected to the left segment 3 of an electric wire screwed to the casing 1, and a movable contact 4 electrically connected to the right segment 5 of the electric wire and normally contacting the stationary contact 2.

In the casing 1, mounted above the linkage 100 is a slidable rotary member 6 which includes a first magnetic block 61 carried on the upper end thereof, and a longitudinal slide slot S1 through which the slidable rotary member 6 is mounted pivotally on the stationary frame 101. The slidable rotary member 6 is capable of moving between an uppermost position shown in the solid line of FIG. 5 and a lowermost position shown in the broken line of FIG. 5 so as to activate the linkage 100 and hence the movable contact 4 to contact with and separate from the stationary contact 2. The slidable rotary member 6 is normally located at its uppermost position, as shown in FIG. 2.

A first tension spring 7 interconnects the slidable rotary member 6 and the linkage 100 for biasing the linkage 100 and hence the movable contact 4 away from the stationary contact 2.

Connected to the left of the linkage 100 is a stop device which is provided for normally hindering the linkage 100 from the linking-up motion resulting from the tension force of the first tension spring 7. A manual switch 200 is disposed above the upper wall of the casing 1. An automatically indicating device 300 is drivable by the linkage 100 to indicate the state of overload or short-circuit when the circuit is in the same state.

It should be noted that a vacuum is normally maintained within the casing 1 for the purpose of duration. Alternatively, the casing 1 may be filled with an inert gas.

The stop device includes a first L-shaped crank C1, means for biasing the first L-shaped crank C1 to rotate clockwise, an electromagnet including a core 10 and a coil 11 surrounding the core 10, an inverted V-shaped armature 12 disposed rotatably between the first L-shaped crank C1 and the electromagnet, and a second tension spring 13 for biasing the armature 12 away from the electromagnet. The first L-shaped crank C1 is mounted pivotally on the stationary frame 101 by a first stationary pivot P1. The left arm of the first L-shaped crank C1 is provided with a raised stopper 8 thereon for normally blocking a portion of the linkage 100 to hinder the linkage 100 from the linking-up motion resulting from the tension force of the first tension spring 7. The right arm of the first L-shaped crank C1 is provided with a pin 9 at the free end thereof. An torsion spring (not shown) is installed on the first stationary pivot P1 of the first L-shaped crank C1 for biasing the first L-shaped crank C1 to rotate clockwise. The coil 11 is formed of a part of the right segment 5 of the electric wire. The inverted V-shaped armature 12 consists of a right arm normally separated from the core 10 by the second tension spring 13, and a left arm normally abutting on the pin 9 so as to permit the stopper 8 to block the portion of the linkage 100. It is noted that the magnetic attractive force between the right arm of the armature 12 and the electromagnet resulting from the state of overload or short-circuit is larger than the tension force of the second tension spring 13.

The manual switch 200 includes a sub-casing 14 fixed on the upper wall of the casing 1, a rotary knob 15 having an axle 16 mounted rotatably in the sub-casing 14, and a first permanent magnet M1 secured to the lower end of the axle 16. The magnetic pole of the first permanent magnet M1 is movable toward or away from the first magnetic block 61 via a first bridging magnet B1 for generating or releasing the magnetic attractive force between the first permanent magnet M1 and the first magnetic block 61 to close or open the circuit. It is also noted that when the magnetic pole of the first permanent magnet M1 is brought into registry with the first magnetic block 61, the magnetic attractive force between the first permanent magnet M1 and the first magnetic block 61 is larger than the tension force of the first tension spring 7. The release of the magnetic attractive force between the first permanent magnet M1 and the first magnetic block 61 permits the slidable rotary member 6 to rotate clockwise to its lowermost position so as to activate the linkage 100 to move the movable contact 4 away from the stationary contact 2, as shown in the broken line of FIG. 5, otherwise the slidable rotary member 6 will be attracted to its uppermost position, as shown in the solid line of FIG. 5.

The automatically indicating device 300 includes a push rod 17, a second magnetic block 18, and a forked rotary member 19 disposed rotatably between the second magnetic block 18 and the push rod 17. Integral with the axle 16 is the push rod 17 having a generally barb-shaped free end 171 with a rounded end surface (see FIG. 7). The second magnetic block 18 is connected to the linkage 100. When the circuit is in a normal condition (see FIG. 2), or when the manual switch 200 is switched off (see FIG. 5), the second magnetic block 18 is located at its uppermost position, as shown in the solid line of FIG. 3. And, when the circuit is converted into the state of overload or short-circuit, the second magnetic block 18 is moved by the linkage 100 to its lowermost position, as shown in the broken line of FIG. 3. The push rod 17 is movable between an ON-position shown in the solid line of FIG. 7 and an OFF-position shown in the broken line of FIG. 7.

Figure 6:
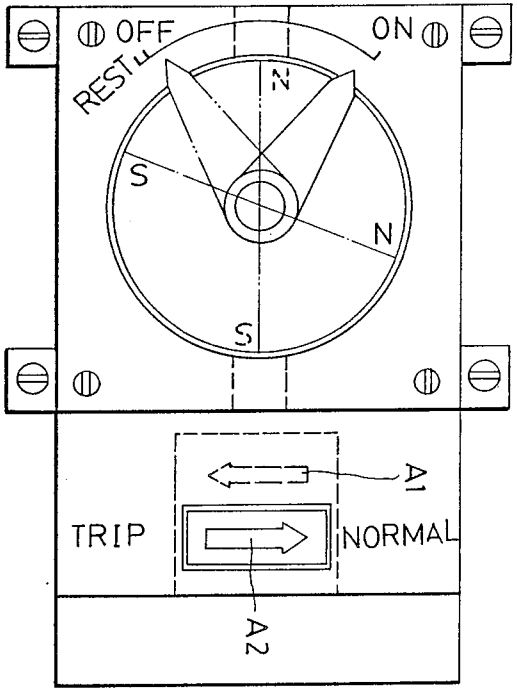
FIG. 6 is a top view showing the manual switch of the FIG. 2 circuit breaker.
Figure 7:
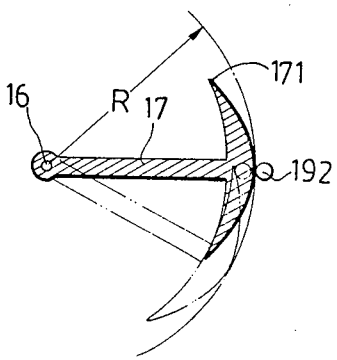
FIG. 7 is a horizontal sectional view taken along the line 7—7 of FIG. 2, illustrating the relationship between the push rod and the longitudinal arm of the forked rotary member of the FIG. 2 circuit breaker in broken lines.

The forked rotary member 19 includes a horizontal arm 191 with a forked free end 20, and a longitudinal arm 192. A second permanent magnet M2 is secured to the lower branch 21 of the forked free end 20. When the second magnetic block 18 moves to its uppermost position due to the state of overload or short-circuit, the second permanent magnet M2 is attracted by the second magnetic block 18 to rotate the forked rotary member 19 clockwise. Referring to FIG. 6, two aligned words "TRIP" and "NORMAL" are indicated on the outer surface of the automatically indicating device 300 on the opposite sides of a transparent glass window 24.

In addition, indicated on the upper branch 22 of the forked free end 20 are a broken arrow A1 and a solid arrow A2 indicated below the broken arrow A1, which are in an opposite direction, that is, the broken arrow A1 directs to the side of the word "TRIP" and the solid arrow A2 directs to the side of the word "NORMAL". The two arrows A1 and A2 are spaced from each other at a predetermined distance so that the arrows A1 and A2 are visible from the glass window 24 when the forked rotary member 19 is located at its uppermost and lowermost positions. The longitudinal arm 192 of the forked rotary member 19 is capable of being pushed by the push rod 17 to rotate the forked rotary member 19 counterclockwise after the second permanent magnet M2 has been attracted by the second magnetic block 18 via a second bridging magnet B2 due to the state of overload or short-circuit and when the manual switch 200 is switched on moving the push rod 17 to register with the longitudinal arm 192 of the forked rotary member 19 (see FIG. 7). A third tension spring 23 is connected to the horizontal arm 191 of the forked rotary member 19 for biasing the second permanent magnet M2 away from the second magnetic block 18 to rotate the forked rotary member 19 counterclockwise. It is noted that the tension force of the third tension spring 23 is smaller than the magnetic attractive force between the second permanent magnet M2 and the second magnetic block 18 when the second magnetic block 18 is located at its uppermost position.

Referring to FIG. 2, the linkage 100 includes in turn from the left to the right:

(1) a second L-shaped crank C2, mounted pivotally on the stationary frame 101 at the left end of the linkage 100 by a second stationary pivot P2, including a left crank arm connected to the slidable rotary member 6 by the first tension spring 7 and connecting the movable contact 4 to the left end of the right segment 5 of the electric wire by an electrically conductive portion 25 provided on the left crank arm of the second L-shaped crank C2, and a right crank arm;

(2) a four-bar sub-linkage, consisting of a first coupler L1 at the left upper portion, a second coupler L2 at the left lower portion, a first single-arm crank C3 mounted pivotally on the stationary frame 101 by a third stationary pivot P3 at the right lower portion, and a rotatable frame at the right upper portion. It is connected to a pivot of the slidable rotary member 6 by a third coupler L3 at a movable pivot R1 between the second coupler L2 and the first single-arm crank C3. Additionally, it is connected to a second movable pivot R2 of the right crank arm of the second L-shaped crank C2 by a fourth coupler L4 at the movable pivot R3 between the first coupler L1 and the second coupler L2;

(3) an inverted T-shaped crank C3', mounted pivotally on the stationary frame 101 by the third stationary pivot P3, including a left crank arm forming the rotatable frame of the four-bar sub-linkage, an intermediate crank arm, and a right crank arm;

(4) an L-shaped second single-arm crank C4, disposed at the right upper end portion of the linkage 100, mounted pivotally on the stationary frame 101 by a fourth stationary pivot P4, carrying the second magnetic block 18 on the upper side of the crank arm thereof, connected to the intermediate crank arm of the inverted T-shaped crank C3' by a fifth coupler L5 having a horizontal slide slot S2 through which a crank pin of the second single-arm crank C4 is received slidably; and (5) a third single-arm crank C5, mounted pivotally on the stationary frame 101 at the right upper end of the linkage 100 by a fifth stationary pivot P5, capable of being normally obstructed against the tension force of the first tension spring 7, so that it fails to rotate clockwise, by the stopper 8 at the free end of the third single-arm crank C5, connected to the right crank arm of the inverted T-shaped crank C3' by a sixth coupler L6 at an intermediate portion of the third single-arm crank C5.

It should be further described that when the circuit is in a normal condition, the inverted T-shaped crank C4 and hence the third single-arm crank C5 tend to rotate clockwise due to the tension force of the first tension spring 7. Accordingly, the stopper 8 can obstruct the linkage 100 from movement when the circuit is in a normal condition.

Figure 3:
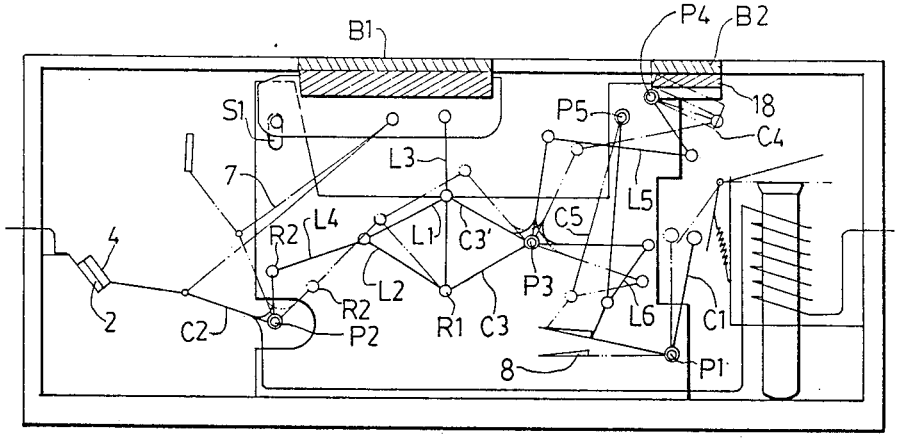
FIG. 3 is a schematic view illustrating the linking-up motion of the linkage of the FIG. 2 circuit breaker when it is converted into the state of overload or short-circuit.

The linking-up motion of the linkage 100 resulting from the state of overload or short-circuit is shown in FIG. 3. Once the circuit is converted into the state of overload or short-circuit, the right arm of the armature 12 will be attracted by the electromagnet to rotate clockwise so that the left arm of the armature 12 pushes the first L-shaped crank C1 to rotate counterclockwise, thereby causing the stopper 8 to move away from the free end of the third single-arm crank C5 so as to permit the first tension spring 7 to activate the linkage 100.

Figure 1:
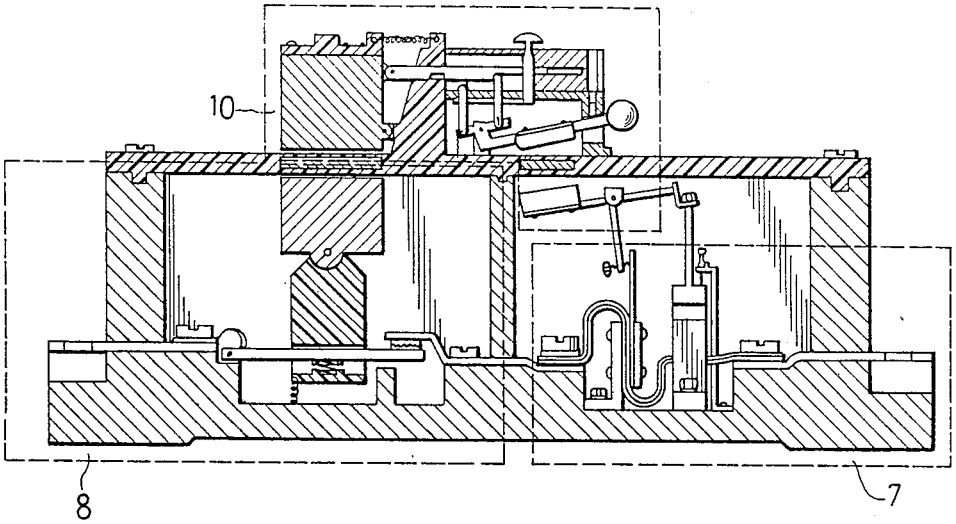
F I G. 1 PRIOR ART
FIG. 1 is a vertical sectional view showing a conventional automatic magnetic switch.
Figure 4:
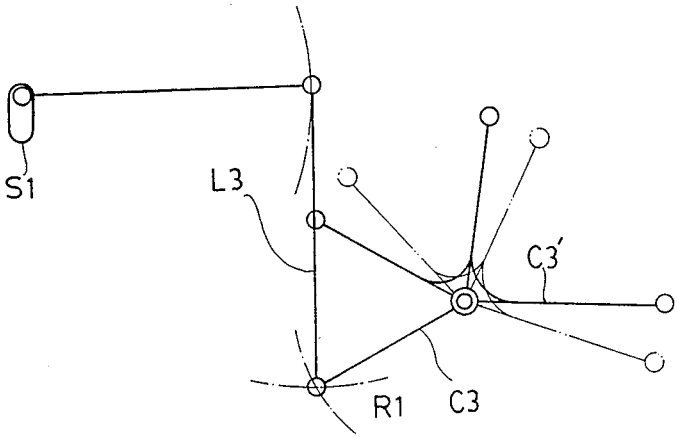
FIG. 4 is a schematic view indicating the partial analysis of the linking-up motion of the linkage of FIG. 3.

In the linking-up motion of linkage 100 resulting from the state or overload or short-circuit, referring to FIG. 4, since the third coupler L3 is pivoted to the slidable rotary member 6, the first movable pivot R1 between the third coupler L3 and the first single-arm crank C3 is fixed at a position as shown in FIG. 4 due to the fact that two interconnecting cranks are incapable of rotating.

When the free end of the third single-arm crank C5 is released, as shown in FIG. 3, the first tension spring 7 pulls the movable contact 4 away from the stationary contact 2. At the time of pulling the movable contact 4, it rotates the second L-shaped crank C2 clockwise so as to rotate the second movable pivot R2 to the right, then, the fourth coupler L4 and hence the first coupler L1 push the inverted T-shpaed crank C3' to rotate clockwise, thereby rotating the third L-shaped crank C4 counterclockwise through the fifth coupler L5 to move the second magnetic block 18 to its uppermost position, to attract the second permanent magnet M2, and simultaneously rotating the second single-arm crank C5 clockwise through the sixth coupler L6.

When the second permanent magnet M2 is attracted toward the second magnetic block 18, the forked rotary member 19 rotates clockwise to its lowermost position where the broken arrow A1 indicated on the horizontal crank arm 191 of the forked rotary member 19 is brought into registry with the glass window 24, and thus visible from the glass window 24.

Subsequently, when the circuit is restored to its normal condition from the overload or short-circuit state, since the magnetic attractive force between the right arm of the armature 12 and the electromagnet has been eliminated, the right arm of the armature 12 is pulled by the second tension spring 13 away from the electromagnet so that the left arm of the armature 12 moves away from the pin 9 of the first L-shaped crank C1. At this time, the left arm of the first L-shaped crank C1 is rotated by the torsion spring (not shown) to the position of FIG. 2. The manual switch 200 may be then reset. Firstly, the manual switch 200 is switched off so that the magnetic pole of the first permanent magnet M1 is moved away from registry with the first magnetic block 61 so that the first magnetic block 61 moves to its lowermost position. Secondly, the manual switch 200 is switched on so that the first magnetic block 61 is attracted by the first permanent magnet M1 to move back its uppermost position. On the other hand, referring to FIG. 7, the push rod 17 pushes the longitudinal arm 192 of the forked rotary member 19 to rotate the forked rotary member 19 counterclockwise by the assistance of the third tension spring 23, thereby permitting the second magnetic block 18 to fall back its lowermost position so as to completely restore the normal condition shown in FIG. 2, and thereby rotating the forked rotary member 19 to its upper position where the solid arrow A2 is visible from the glass window 24.

Figure 5:
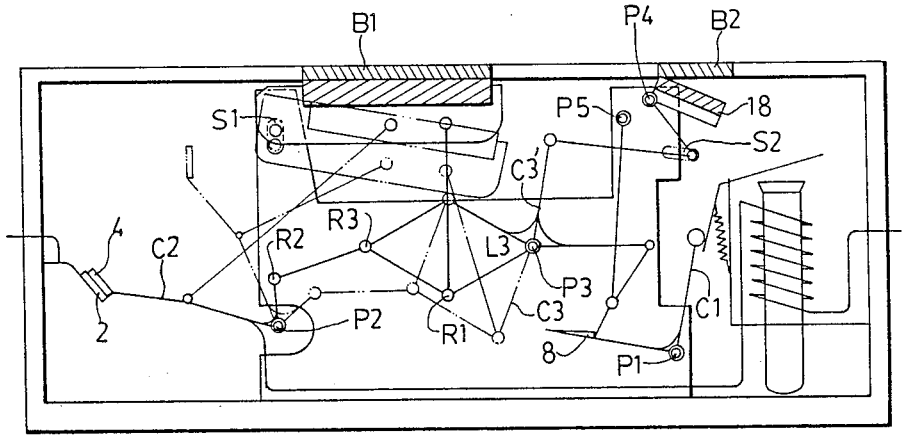
FIG. 5 is a schematic view illustrating the linking-up motion of the linkage of the FIG. 2 circuit breaker when a manual switch is switched off.

Referring to FIG. 5, when an emergency is encountered by the circuit, the manual switch 200 can be instantly switched off so as to open the circuit. In operation, when the manual switch 200 is switched off, the slidable rotary member 6 moves to the its lowermost position, as described above. Since the stopper 8 blocks the free end of the second single-arm crank C5, the inverted T-shaped crank C3' is incapable of rotation. Thus, the downward movement of the slidable rotary member 6 and hence the third coupler L3 causes the first single-arm crank C3 to rotate counterclockwise so that the second L-shaped crank C2 is rotated clockwise to move the movable contact 4 away from the stationary contact 2.

It should be understood that the upper wall of the casing 1 is preferably provided with the bridging magnets B1 and B2 respectively disposed between the first permanent magnet M1 and the first magnetic block 61 as well as the second permanent magnet M2 and the second magnetic block 18 in order to concentrate the magnetic flux to thus enhance the attractive force therebetween.

In addition, the longitudinal and horizontal slide slots S1 and S2 are respectively used to facilitate smooth movement of the first and second magnetic blocks 61, 18 at the very inception of starting.

Alternatively, the stop device may be replaced by other arrangement, such as a bi-metal device or other electromagnetic relays.

Figure 8:
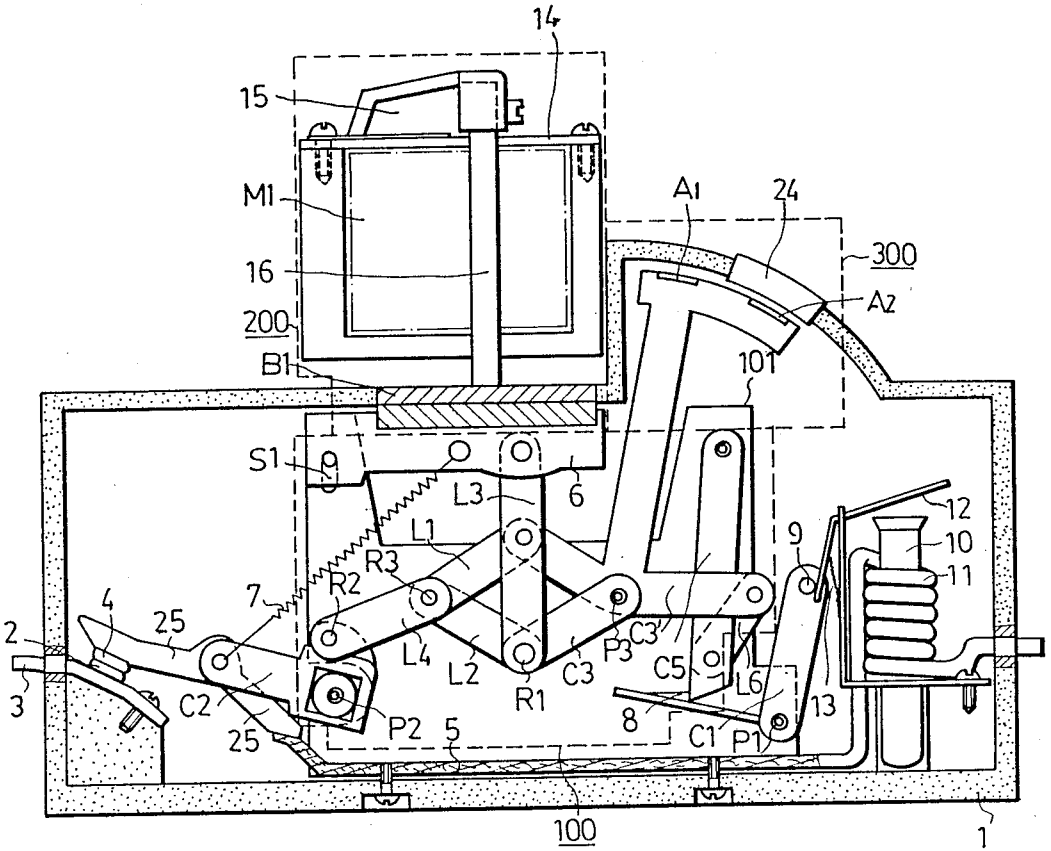
FIG. 8 is a vertical sectional view showing another embodiment of the magnetic vacuum circuit breaker according to the present invention.

Referring to FIG. 8, which shows another embodiment of the present invention. The second embodiment is similar to the first embodiment in construction except that it has a simpler automatically indicating device. In FIGS. 2 and 8, like parts are, indentified by the same reference numerals. In this embodiment, the automatically indicating device 300 is completely received sealingly within the casing 1 along with the linkage 100 and the stop device. The inverted T-shaped crank C3' has an elongated intermediate crank arm having a curved free end with an end surface on which a broken arrow A1 and a solid arrow A2 provided below the broken arrow A1 are indicated. The directions of the arrows A1 and A2 are similar to those of the first embodiment. When the circuit is in a normal condition, the solid arrow A2 directing to the word "NORMAL" is visible from the glass window 24.

Similarly, when the circuit is converted into the state of overload or short-circuit, the inverted T-shaped crank C3' rotates clockwise so that the broken arrow A1 directing to the word "TRIP" is visible from the glass window 24.

With the present invention thus explained, it is apparent that various modifications and variations can be made without departing from the scope and spirit of the present invention. It is therefore intended that the present invention be limited as indicated in the appended claims.

What is claimed is:

1. A circuit breaker comprising:

a casing;

a contact device, mounted sealingly in said casing, including a stationary contact and a movable contact normally contacting said stationary contact;

a linkage connected to said movable contact in said casing;

a first lower magnetic member, mounted pivotally in said casing, connected to and disposed above said linkage, rotatable between an uppermost position and a lowermost position to activate said linkage and hence said movable contact to electrically connect with and disconnect from said stationary contact, normally located at its uppermost position;

a first tension spring interconnecting said first lower magnetic member and said linkage for biasing said linkage and hence said movable contact away from said stationary contact;

a stop device, connected to said linkage for normally hindering said linkage from the linking-up motion resulting from the tension force of said first tension spring, responsive to the state of overload or short-circuit by releasing said linkage to be biased by said first tension spring to move said movable contact away from said stationary contact;

a manual switch, including a sub-casing fixed on the upper wall of said casing, an actuator member movable between ON and OFF positions in said subcasing, and a first upper magnetic member drivable by said actuator member to move in said subcasing toward or away from said first lower magnetic member for generating or releasing the magnetic attractive force between said first upper and lower magnetic members to close or open the circuit, the release of the magnetic attractive force between said first upper and lower magnetic members causing said first lower magnetic member to move to its lowermost position so as to activate said linkage to move said movable contact away from said stationary contact, the magnetic attractive force between said first upper and lower magnetic members being larger than the tension force of said first tension spring;

an automatically indicating device drivable by said linkage to indicate the state of overload or short-circuit when the circuit is converted into the same state;

whereby, when the circuit is converted into the state of overload or short-circuit, said linkage is released from said stop device, then, due to the linking-up motion of said linkage resulting from the tension force of said first tension spring, said movable contact moves away from said stationary contact to open the circuit, at this time the overload or short-circuit state is indicated by said automatically indicating device; subsequently, said manual switch may be reset to restore the magnetic switch to a normally closed condition.

2. A circuit breaker as claimed in claim 1, wherein said stop device comprises:

a first L-shaped crank, including a left arm with a raised stopper provided on said left arm of said first L-shaped crank for normally blocking a portion of said linkage for hindering said linkage from the linking-up motion resulting from the tension force of said first tension spring, and a right arm with a pin provided on the free end of said right arm of said first L-shaped crank;

means for biasing said stopper of said first L-shaped crank to block said portion of said linkage;

an electromagnet, including a core, and a coil surrounding said core and electrically connected to an electric wire;

an inverted V-shaped armature, disposed rotatably between said electromagnet and said first L-shaped crank and normally spaced from said electromagnet, including a right arm normally located adjacent to said core of said electromagnet, and a left arm normally abutting on said pin of said first L-shaped crank so as to permit said stopper to block said portion of said linkage; and a second tension spring for biasing said right arm of said armature away from said electromagnet, the magnetic attractive force between said right arm of said armature and said electromagnet resulting from the state of overload or short-circuit being larger than the tension force of said second tension spring;

whereby, when the circuit is converted into the state of overload or short-circuit so that said right arm of said armature is attracted by said electromagnet to rotate said armature, said left arm of said armature pushes said pin of said first L-shaped crank to rotate said first L-shaped crank so as to move said stopper away from said portion of said linkage, thereby activating said linkage to move said movable contact away from said stationary contact.

3. A circuit breaker as claimed in claim 1, wherein said linkage includes:

a second L-shaped crank, disposed at the left end of said linkage, including a left crank arm carrying said movable contact thereon and connected to said first lower magnetic member by said first tension spring, and a right crank arm;

a four-bar sub-linkage, connected to said right crank arm of said second L-shaped crank by a coupler, and connected to said first lower magnetic member by a coupler;

an inverted T-shaped crank, including a left crank arm forming a rotatable frame of said four-bar sub-linkage, an intermediate crank arm, and a right crank arm; and a single-arm crank, disposed at the right end of said linkage, connected to said right crank arm of said inverted T-shaped crank by a coupler at an intermediate portion of said single-arm crank, having a free end normally blocked by said stop device so as to fail to rotate under the tension force of said first tension spring;

whereby, when the circuit is converted into the state of overload or short-circuit, said free end of said single-arm crank is released from said stop device, thereby activating said linkage to open the circuit.

4. A circuit breaker as claimed in claim 3, wherein said automatically indicating device comprises:

a push rod, mounted in said sub-casing, secured horizontally to said actuator member so that it is drivable to rotate, having a rounded free end rotatable between ON and OFF positions;

an L-shaped single-arm crank, mounted in said casing, connected to said intermediate crank arm of said inverted T-shaped crank by a coupler;

a second lower magnetic member, carried on said L-shaped single-arm crank near the upper wall of said casing so that it is capable of moving between an uppermost position and a lowermost position, normally located at its lowermost position, drivable by said linkage to move to its uppermost position when the circuit is converted into the state of overload or short-circuit;

a transparent indicating window disposed on said sub-casing;

a rotary member, mounted in said sub-casing, rotatable between an uppermost position and a lowermost position, having a longitudinal arm pushable by said rounded free end of said push rod to rotate said rotary member when said manual switch is reset, and a horizontal arm with a two-pronged free end which has a lower branch and a curved upper branch, said curved upper branch having two characters the upper one of which is used to indicate "TRIP" state and the lower one of which is used to indicate "NORMAL" state, said two characters being spaced from each other at a predetermined distance depending on the relationship between the uppermost and lowermost positions of said rotary member so that said characters are respectively visible from said indicating window when said rotary member is located at its uppermost and lowermost positions;

a second upper magnetic member, carried on said lower branch of said forked free end of said rotary member, attractable downwardly by said second lower magnetic member to rotate said rotary member when said second lower magnetic member is located at its uppermost position; and a third tension spring for pulling said second upper magnetic member away from said second lower magnetic member to rotate said rotary member, the tension force of said third tension spring being smaller than the magnetic attractive force between said upper and lower magnetic members when said lower magnetic member is located at its uppermost position;

whereby, when the circuit is converted into the state of overload or short-circuit, said second upper magnetic member is attracted downwardly to rotate said rotary member in a direction, thereby causing said upper character indicating the "TRIP" state to be visible from said indicating window, and, when said manual switch is reset, said push rod pushes said longitudinal arm of said rotary member to rotate said rotary member in the opposite direction, thereby causing said lower character indicating the "NORMAL" state is visible form said indicating window.

5. A circuit breaker as claimed in claim 3, wherein said automatically indicating device comprises:

a transparent indicating window disposed on the upper wall of said casing near said inverted T-shaped crank; and a curved free end of said intermediate arm of said inverted T-shaped crank having an end surface on which two characters are indicated one above the other, the upper character indicating "TRIP" state and the lower character indicating "NORMAL" state, said lower character being located so that it is visible from said indicating window when the circuit is in a normal condition, said characters being spaced from each other at a predetermined distance depending on the maximum displaceable distance of said curved free end so that said upper character is visible from said indicating window when the circuit is in the state of overload or short-circuit;

whereby, when the circuit is converted into the state of overload or short-circuit, said inverted T-shaped crank rotates so that said upper character indicating the "TRIP" state is visible from said indicating window.

6. A circuit breaker as claimed in claim 1, wherein said actuator member of said manual switch is a rotary knob.

7. A circuit breaker as claimed in claim 1, wherein vacuum is maintained within said casing.

8. A circuit breaker as claimed in claim 1, wherein said casing is filled with an inert gas.

9. A circuit breaker as claimed in claim 1, wherein casing includes a bridging magnet disposed on said casing between said first upper and lower magnetic members so as to concentrate the magnetic flux to enhance the magnetic attractive force therebetween.

10. A circuit breaker as claimed in claim 1, wherein said casing includes a bridging magnet disposed on said casing between said second upper and lower magnetic members so as to concentrate the magnetic flux to enhance the magnetic attractive force therebetween.

* * * * *